US010953660B2

(12) United States Patent
M Lachmanan

(10) Patent No.: US 10,953,660 B2
(45) Date of Patent: Mar. 23, 2021

(54) INKJET PRINT HEAD DEVICE AND A METHOD AND SYSTEM FOR DETECTING INK LEAKAGE

(71) Applicant: SICPA HOLDING SA, Prilly (CH)

(72) Inventor: Jayakanthan M Lachmanan, Johor (MY)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 16/474,062

(22) PCT Filed: Nov. 10, 2017

(86) PCT No.: PCT/EP2017/078851
§ 371 (c)(1),
(2) Date: Jun. 26, 2019

(87) PCT Pub. No.: WO2018/121909
PCT Pub. Date: Jul. 5, 2018

(65) Prior Publication Data

US 2019/0337300 A1 Nov. 7, 2019

(30) Foreign Application Priority Data

Dec. 27, 2016 (EP) ..... 16206946

(51) Int. Cl.
*B41J 2/175* (2006.01)

(52) U.S. Cl.
CPC .. *B41J 2/17566* (2013.01); *B41J 2002/17579* (2013.01)

(58) Field of Classification Search
CPC ... B41J 2/175; B41J 29/38; B41J 2/085; B41J 2/09; B41J 2/1707; B41J 2/1714;
(Continued)

(56) References Cited

U.S. PATENT DOCUMENTS 4,023,183 A 5/1977 Takano et al.
4,661,822 A 4/1987 Hirota et al.
(Continued)

FOREIGN PATENT DOCUMENTS

CN 101909892 12/2010
EP 1812239 6/2009
(Continued)

OTHER PUBLICATIONS

International Search Report and Written Opinion issued with respect to application No. PCT/EP2017/078851.
(Continued)

*Primary Examiner* — Jannelle M Lebron
(74) *Attorney, Agent, or Firm* — Muncy, Geissler, Olds & Lowe, P.C.

(57) ABSTRACT

The present invention relates to an inkjet print head device for continuous inkjet printing, comprising a transducer; a charge electrode; a deflection plate; a gutter; and a holster; provided that the holster is receiving at least the aforementioned components, wherein the holster comprises an opening for a dedicated outlet for the ink in a printing mode, and wherein the holster further comprises an ink leakage detection area. Further the invention relates to a method and a system for detecting ink leakage in a print head.

13 Claims, 7 Drawing Sheets

(58) Field of Classification Search
CPC .... B41J 2/185; B41J 2002/17579; B41J 2/08; B41J 2/125; B41J 2/14153; B41J 2/1721; B41J 2/17509; B41J 2/17566
See application file for complete search history.

(56) References Cited

U.S. PATENT DOCUMENTS

| | | | | |
|---|---|---|---|---|
| 6,402,277 | B1 | 6/2002 | Monclús et al. | |
| 6,431,678 | B2 | 8/2002 | Beck et al. | |
| 8,864,275 | B2 | 10/2014 | Batchelor et al. | |
| 2017/0144448 | A1* | 5/2017 | Smith | B41J 2/17566 |

FOREIGN PATENT DOCUMENTS

| | | | |
|---|---|---|---|
| EP | 2292433 | | 3/2011 |
| JP | 63130347 | | 6/1988 |
| JP | 05193137 | | 8/1993 |
| JP | H1086357 | A * | 4/1998 |
| WO | 2009081110 | | 7/2009 |

OTHER PUBLICATIONS

International Preliminary Report on Patentability issued with respect to application No. PCT/EP2017/078851.
Extended European Search Report (EESR) in counterpart European Application No. 16206946.2-1701 dated Jun. 27, 2017.
Chinese Office Action in counterpart Chinese Application No. 201780080781.1 dated Jun. 3, 2020 (along with the English Translation of the Office Action).

* cited by examiner

INKJET PRINT HEAD DEVICE AND A METHOD AND SYSTEM FOR DETECTING INK LEAKAGE

TECHNICAL FIELD

The present invention relates to an inkjet print head device and a method for detecting ink leakage.

BACKGROUND OF THE INVENTION

In continuous ink jet printing dots with a size of about 70 μm of size will be travelling at a high speed from an orifice to a gutter in standby printing mode. A gutter is a kind of a return pipeline, for collecting the ink exiting in standby mode.

Upon printing the dots passing are deflected via charge electrodes and a high voltage deflection plate to form a printing pattern based on object's movement speed. The ink dots misaligned from entering the gutter or deflected far away from the holster's exit path will build up as waste and accumulating in a holster cover and finally drip on the product and/or conveyor causing unfavorable stains.

All this will be undetected until physical notice by a human or a vision inspection system.

Some ink leakage detection systems are known in the prior art, which refer to leakage detection in the ink supply system (U.S. Pat. No. 8,864,275B2, U.S. Pat. No. 6,402,277B1, EP 1 812 239B1). Further to that ink leakage detection is known from U.S. Pat. No. 6,431,678B2, where ink leakage is detected on the print head substrate.

Further to that, in printing with security inks, there is a threat of stealing the security ink by unauthorized users by siphoning via tweaking the print head. Accordingly, it is an object of the present invention to provide a printing head that includes a mechanism that detects when a) ink has escaped its confined space and b) abnormal security situation has occurred.

Problems to be Solved by the Present Invention

The present invention aims at designing a continuous ink jet print head device that is able to detect ink leakage.

Further, the present invention aims to design a suitable continuous ink jet print head device to minimize the risk of unauthorized ink siphoning.

SUMMARY

The above mentioned problems and drawbacks of the conventional concepts are solved by the subject-matter of the embodiments of the present invention.

DETAILED DESCRIPTION

According to one aspect, the invention suggests an inkjet print head device for detecting ink leakage in continuous inkjet printing, comprising a transducer, a charge electrode, a deflection plate, a gutter and a holster, provided that the holster is receiving at least the aforementioned components and wherein the holster comprises an opening for a dedicated outlet for the ink in a printing mode, and wherein the holster further comprises an ink leakage detection area.

The ink leakage detection area comprised by the holster is preferably designed to detect ink leak from the print head of a continuous ink jet printer.

According to a preferred embodiment of the invention the ink leakage detection area is at least provided inside the holster and in a zone neighboring the outlet of the holster.

In yet a further preferred embodiment according to the invention, the ink leakage detection area is a pad.

The pad preferably covers at least a part of a holster component.

According to a preferred embodiment of the invention the holster further receives a charge driver, an ink supply, an ink pump, and/or a driver.

Preferably the ink leakage detection area comprises a non-conductive substrate and conductive circuit provided thereon.

Further, to yet another aspect it is further suggested a system for detecting ink leakage in a print head for continuous inkjet printing, comprising a print head device as describer, a sensor controller, operatively connected to the ink leakage detection area and a main controller for monitoring the signals from the sensor.

According to a preferred embodiment the system according to the invention further comprises a sensor for detecting unauthorized manipulation of the holster.

This sensor can create for example a signal, that the holster is connected.

According to another aspect the invention describes a method for detecting ink leakage providing a signal from a leakage detection area of a holster of a print head device, a signal referring about the status of the holster, a signal referring about a wiring connection, whereas the signals are sent to a sensor controller and further to a control cabinet.

According to a preferred embodiment an indication is provided by the sensor controller if leakage is detected, holster is not properly closed and/or wiring is not correct, is sensed. The indication could for example be an appearance on a screen and/or one or several lights, preferably LED.

According to a preferred embodiment of the invention the printing process is stopped, as soon as an indication is provided by the sensor controller to the control cabinet that leakage is detected, holster is not properly closed and/or wiring is not connected, is sensed.

Additional it is possible that the production process is stopped, as soon as an indication is received by the control cabinet that leakage is detected, holster is not properly closed and/or wiring is not correct, is detected.

Definitions

A "sensor controller" or sensor box is a device, containing circuits converting the receive signals from a ink leak pad to a digital signal as output to a PLC and according to a preferred embodiment gives indication by a lamp, as a LED for the activated output.

A "control cabinet" as used in this description is similar to a SCL cabinet which hosts the PLC and preferably a touch panel PC program as a human machine interface.

A "PLC" is used for a Digital & Analogue signal processor for a low level program.

In this description "JAVA" is used as a high level program inside a touch panel which interacts with a PLC, a printer, camera etc. and commands the peripheral input and output directly or via the PLC.

SHORT DESCRIPTION OF THE DRAWINGS

The present invention will be described for the sake of better understanding by way of exemplary embodiments. These embodiments may be best understood by taking the following drawings in consideration. In these Figures, FIG. 1 shows a schematic view of a continuous inkjet printing system, as known from the prior art;

FIG. 2 shows a schematic view of a continuous inkjet printing system according to a preferred embodiment of the invention;

FIGS. 3(*a*) and 3(*b*) show a schematic of a holster a) according to prior art and b) according to an embodiment of the invention;

FIGS. 4(*a*) and 4(*b*) show a schematic view of the a) ink leakage pad and of the extended holster with a slot according to further embodiments of the invention;

DESCRIPTION OF PREFERRED EMBODIMENTS

Figure 1:
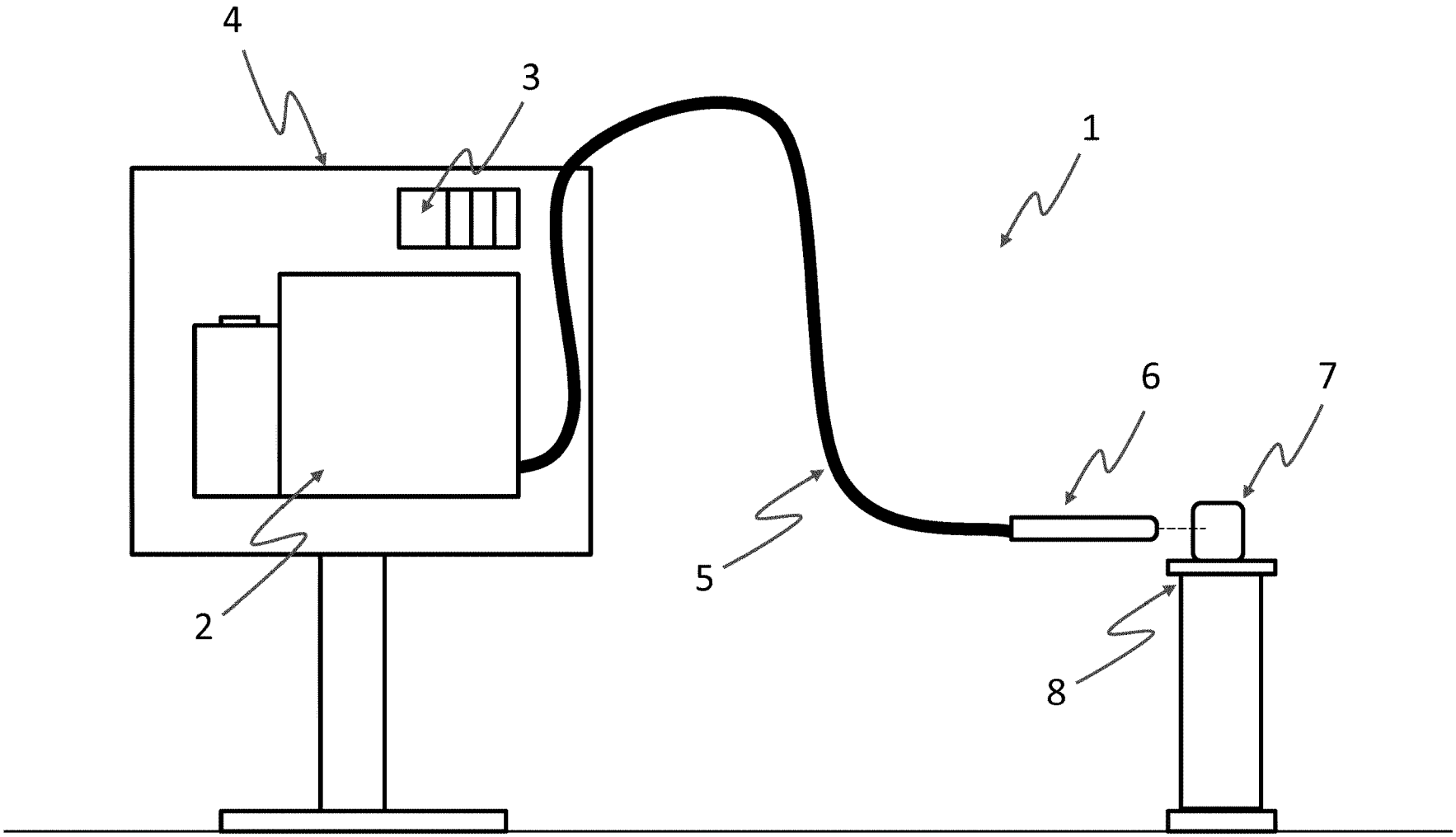

FIG. 1 is a schematic view of a known continuous inkjet printing system (1) including a printer (2), a PLC (Programmable Logic Controller) (3) and printer head. The PLC (3) and the printer (2) are located in a printer security cabinet (4). The print head holster (6) is connected via a umbilical cord (5) for marking a product (7) on a product conveyor (8).

Figure 2:
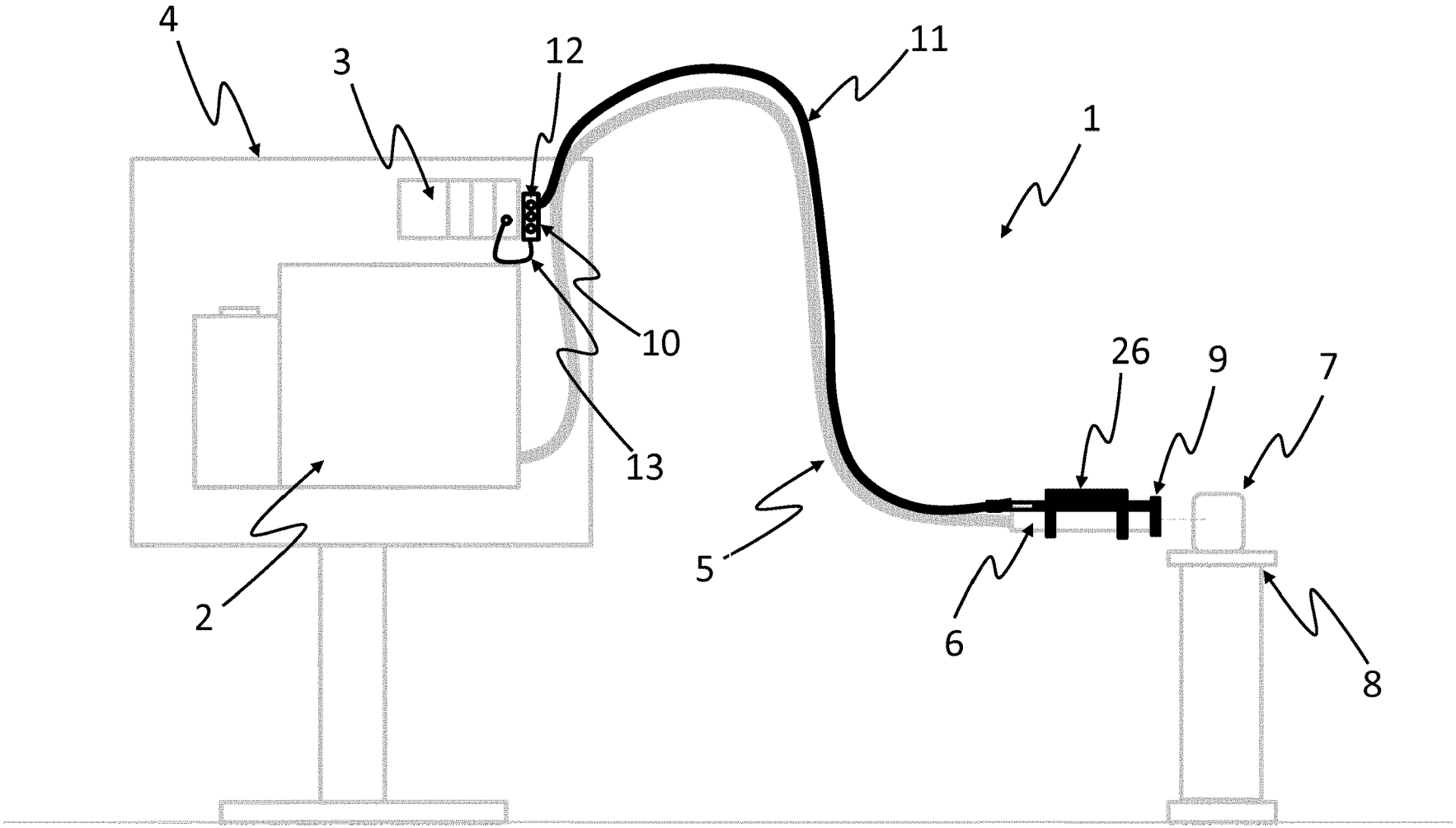

A schematic overview of a printing system according to a preferred embodiment of the invention is shown in FIG. 2. For elements corresponding to the elements of FIG. 1 the same reference numerals are used. According to FIG. 2 it is proposed to include a print head, modified compared to the print head in FIG. 1, to host a sensing leak pad (9). The holster (6) is hold by a print head holder (26) connected to a sensor controller (10), also called sensor box, via a signal cable (11) wherein the sensor controller (10) amplifies and processes an input signal and activates a notification device (12), such as a visual or an audible alert device. The sensor controller (10) also generates and sends three digital input signals to the PLC (3) via an output cable (13) wherein the PLC (3) will enable the printer controller to shut down the operation of printing system if abnormal and/or a leakage detection situation is detected.

The expressions "three digital input signals" and "abnormal situation" will be explained in details further below.

Figure 3A:
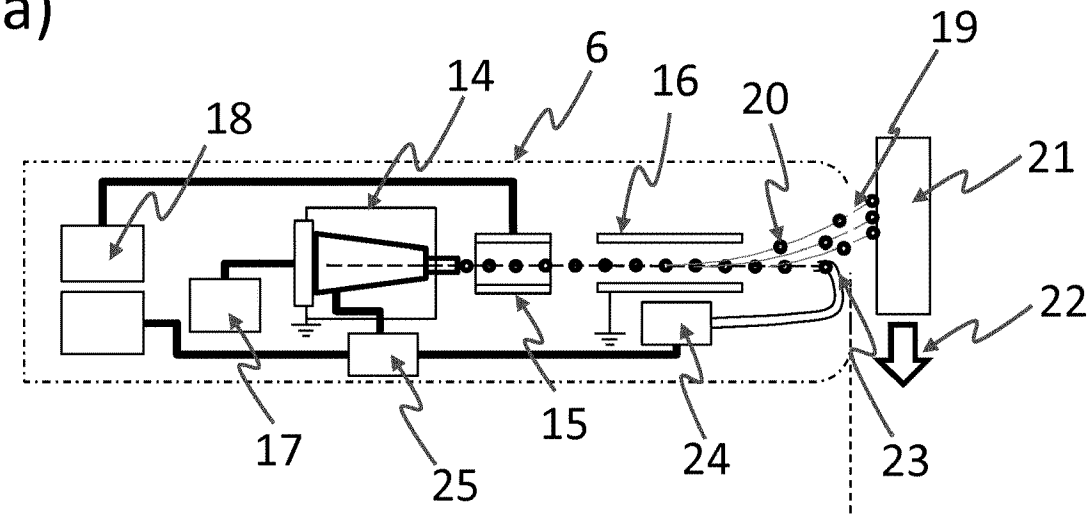
Figure 3B:
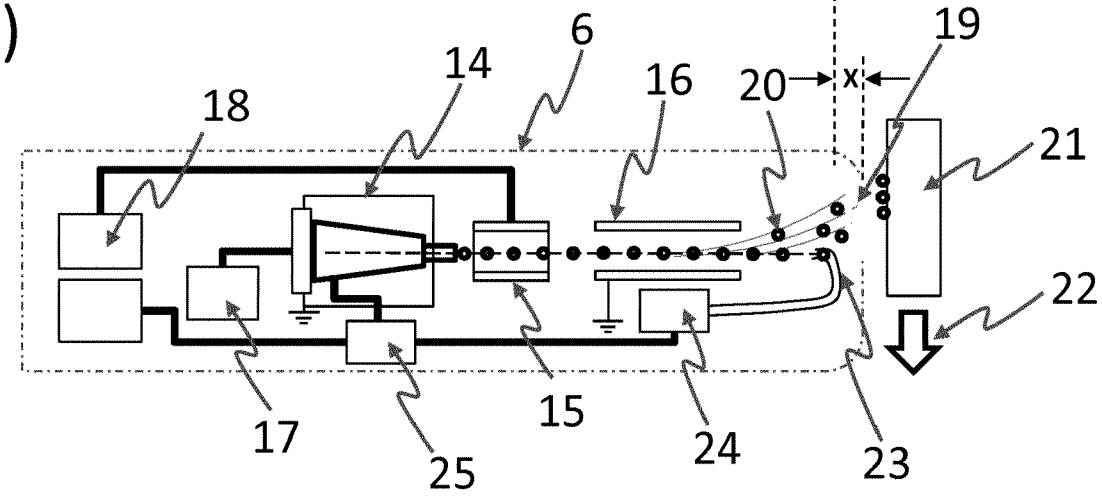

In FIG. 3(*a*) a schematics of a holster (6) according to an embodiment of the prior art is shown. The holster incorporates a transducer (14) connected to a driver (17), a charge electrode (15) connected to a charge driver (18) and a deflection plate (16). The holster (6) comprises an opening (19) for the ink (20) to exit the holster (6) to be printed on an object (21) in motion in direction (22). In the holster (6) is further provided a gutter (23) to collect the ink exiting the print head in stand-by mode. From the gutter (23) the ink (20) is guided to a collector (24) from where the ink is guided to a pump (25).

A schematic holster (6) according to an embodiment of the invention is shown in FIG. 3(*b*). As can be seen from the comparison of FIGS. 3(*a*) and 3(*b*), the holster (6) is extended to enable a leak detection pad to be inserted in the holster (6). The extension x in this example is about 2 mm, and preferably is in the range of 1.6 mm to accommodate a leak detection pad.

Figure 4B:
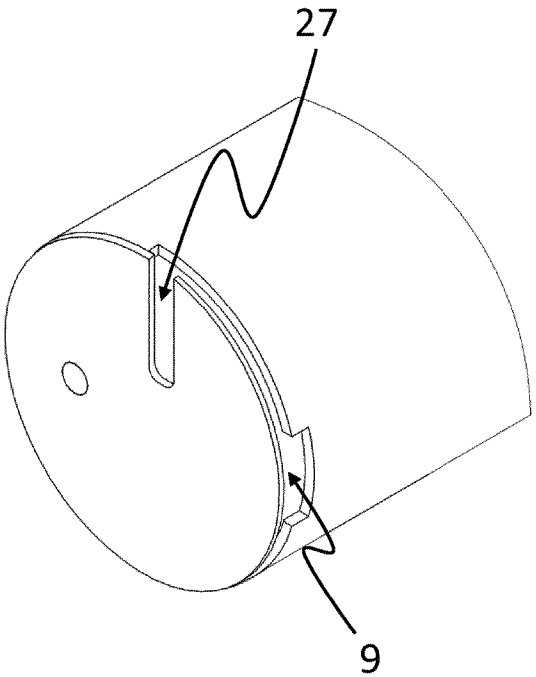
Figure 4A:
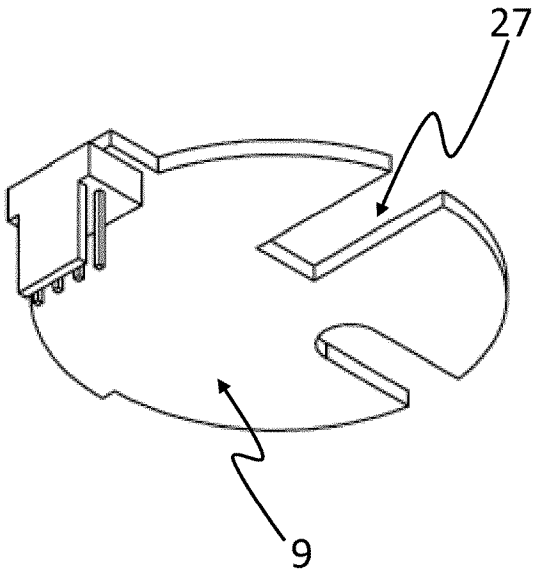

FIGS. 4(*a*) and 4(*b*) show a schematic view of the a) ink leakage pad (9) and b) part of the extended holster (6) with a slot (27) and the mounted holster assembly, i.e. the print head holder (26) according to further embodiments of the invention. The cylindrical holster (6) connects to the print head by slotting in and lock-pin-release button.

Figure 5:
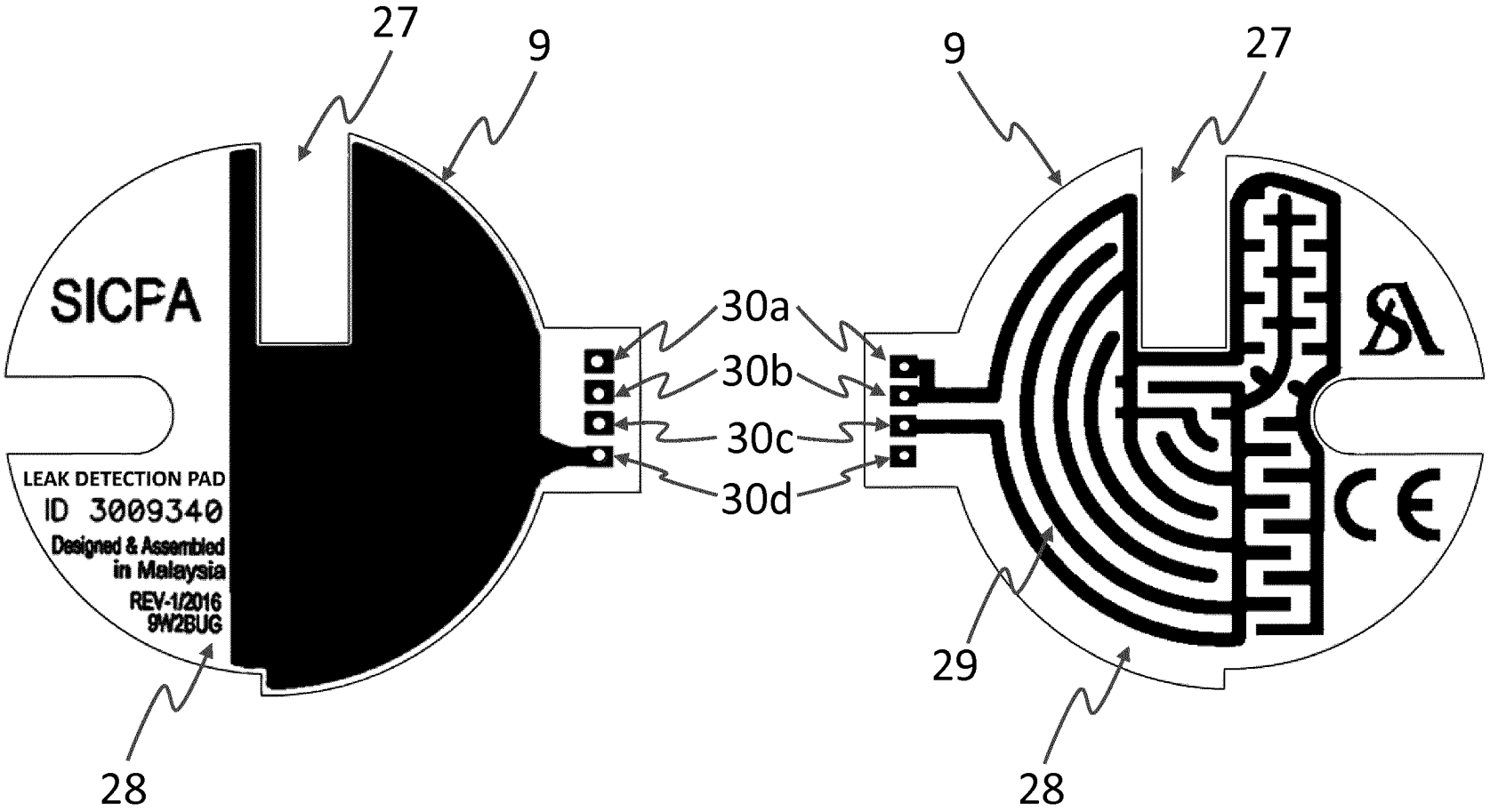
FIG. 5 shows a detailed view of an ink leak sensing pad from both sides according to a preferred embodiment of the invention.

The exemplary sensing leak pad (9), shown in FIG. 5, is a made of a non-conductive substrate (28) with loop like tracks (29) which are according to this embodiment of the invention formed of Tantalum. It could be also formed of other like conductive material that coated with lead free silver to comply with RoHS and CE certified substance.

A power line, +24 VDC is coupled to one of the conductive tracks (29) via a pin 2 (30*b*) and a returning conductive track that senses the leaked current is coupled to pin 3 (30*c*). In case of leakage, the ink conductivity bridges between these track lines (29) and electrically interconnects them thus a signal current is sent to the sensor controller (10) to be processed and send an "ink leak signal" output signal to the PLC (3).

Beside the ink leak signal, two more signals are sent from the sensing leak pad (9) to be sent to the sensor controller (10).

One signal refers to a loop of 24 VDC going back from the sensing leak pad (9) via pin 1 (30*a*) to the sensor controller (10) for "connected signal". The other signal refers to the "mounted signal" which is a 0 VDC ground signal loop coupled to pin 4 (30*d*) coming from printer holster when the nozzle is mounted.

In sum three signals are sent from the sensing leak pad (26) to the sensor controller (10).

A first signal is the holster mounted signal and will enable the whole function of the ink leak system, a second signal is the connection signal against any intruder or attempt to modify any wiring and a third signal is the ink leak signal which will take place only if the first signal of holster mounted is available.

If the leak is detected, it will send the leak detection to the PLC and the printer along with the conveyor will 'STOP' for verification and possibly cleaning. Any incorrect combinations of the three signals above based on the PLC & developed JAVA program, will be detected as 'ABNORMAL' and therefore lead to a stop of the conveyor and shut down the printing system for security verification.

The "Mounted Signal" will be sent to make sure that leak pad hasn't been dislocated from the holster and has been mounted properly which is the 0 Vdc ground signal which will activate the circuit inside the sensor box.

The "Connected signal" gives in indication that no intrusion in the system or attempt to modify any wiring has taken place, which is the looping 24 VDC.

An "Ink Leak Signal" will be available only if the mounted signal of the holster is available which is the open loop awaiting for leak current.

Further to that the PLC signal input, which will be processed by JAVA program, will wait for the "Connected Signal" and "Mounted Signal" in the first place before starting the printer, if any of this signal went missing, it will cause the JAVA program to send "Security Breach" status and will immediately shut down the printer and lock the Secure Printer Cabinet for security verification.

Figure 6:
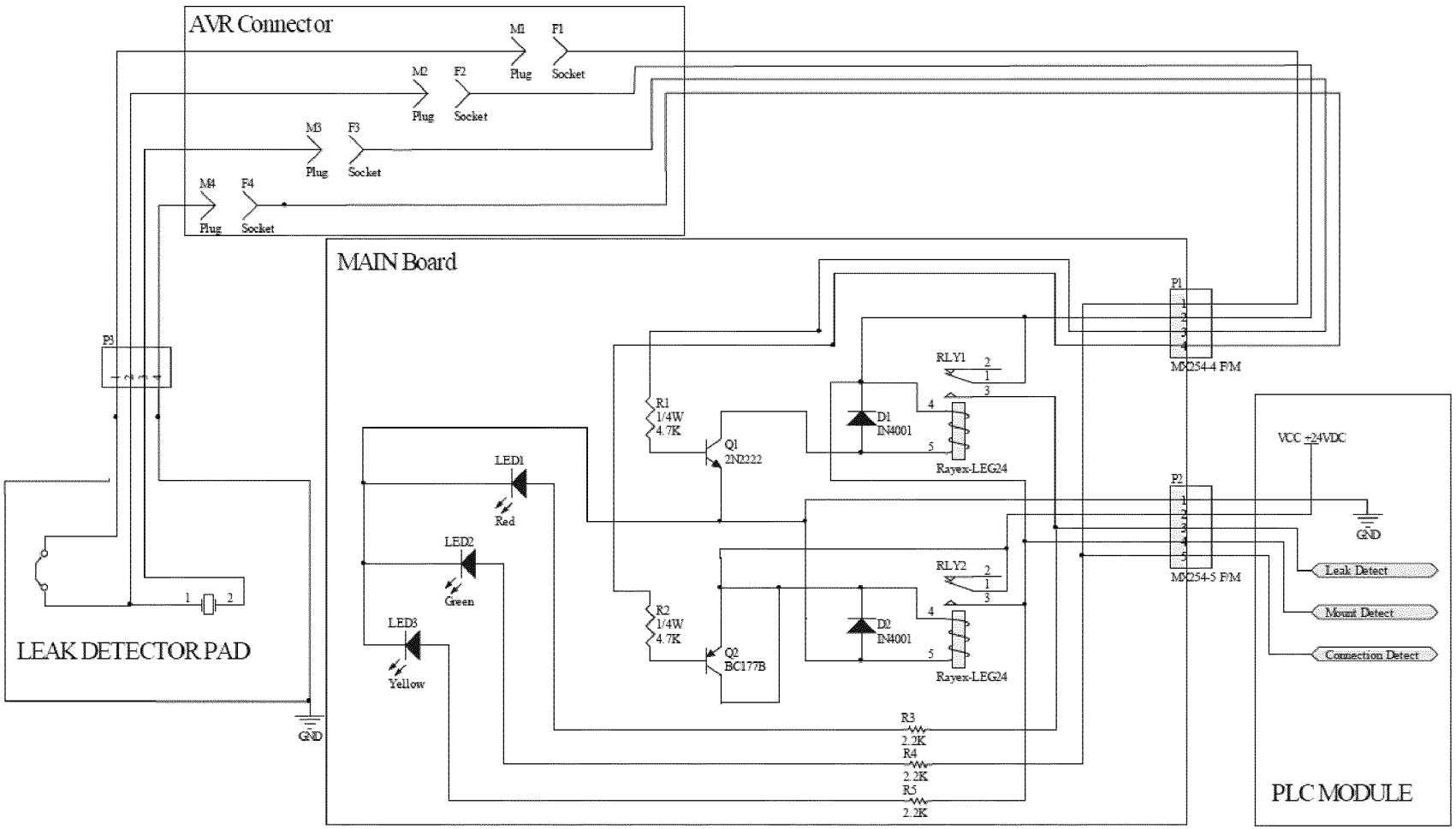
FIG. 6 is an exemplary schematic design of an electrical circuit used in the sensor controller.

FIG. 6 is an exemplary schematic design of an electrical circuit used in the sensor controller (10). The control circuit according to this preferred embodiment includes a BJT NPN transistor Q1 with a base receiving the current signals through a resistor, R1. The collector of Q1 will switch the 0 VDC from common ground connection Emitter to activate the Relay coil RLY1, the Single Pole Double Touch pin in the RLY1 will contact Common pin which carries 24 VDC to Normally Open pin to allow the signal to pass thru the C1 connector pin number 3 as a signal to PLC as Leak Detect and at the same time emits the Red LED1 via current limiter resistor R3 for indication. This process in the circuit will only take place after the PNP BJT transistor Q2 activates the RLY2 when there is 0 VDC ground signal was received by the Base on Q2 once the Leak Pad is mounted inside the print head holster and connected with signal wires and pint head is inserted for the ground signal to connect each other. When the ground signal connects, it is the time where the transistor Q2 receive the 0 VDC signal and activate the Relay RLY2 which the 24 VDC that was connected to Normally Open pin will contact with the Common pin to activate the sensing transistor Q1 and at the same time will send the 24 VDC signal to pin 4 of connector C1 and also indicate the function of Mount Detected by LED2 and the same source of 24 VDC goes to Connector C2 pin number 2 to be looped as activated source signal in return from C3 pin number 1 and ready to detect the ink leak at the pad as signal number 3 from connector C2 and C3. The return 24 VDC as loop from Ink Leak Pad Connector C3 and C2 will be send as Connection Detect signal to pin number 5 of connector C1 for PLC and at the same time will activate the LED3 as Connection Detect indicator. In this circuit the power up signal is ground signal known as Mount Detect from Q2 to activate the 24 VDC to go all over the other sections which will secondly activate the Connection Detect loop for indication of the presence of voltage signal to be ready to activate the Ink Leak detection on the Ink Leak Pad.

The sensor controller (10) also includes a BJT PNP Transistor Q2 which processes the 0 VDC loop to activate the "Mounted Signal" and amplify the whole module. The connected loop is connected to the PLC with a current limiting resistor and LED for indication purpose on the sensor controller (10).

Figure 7:
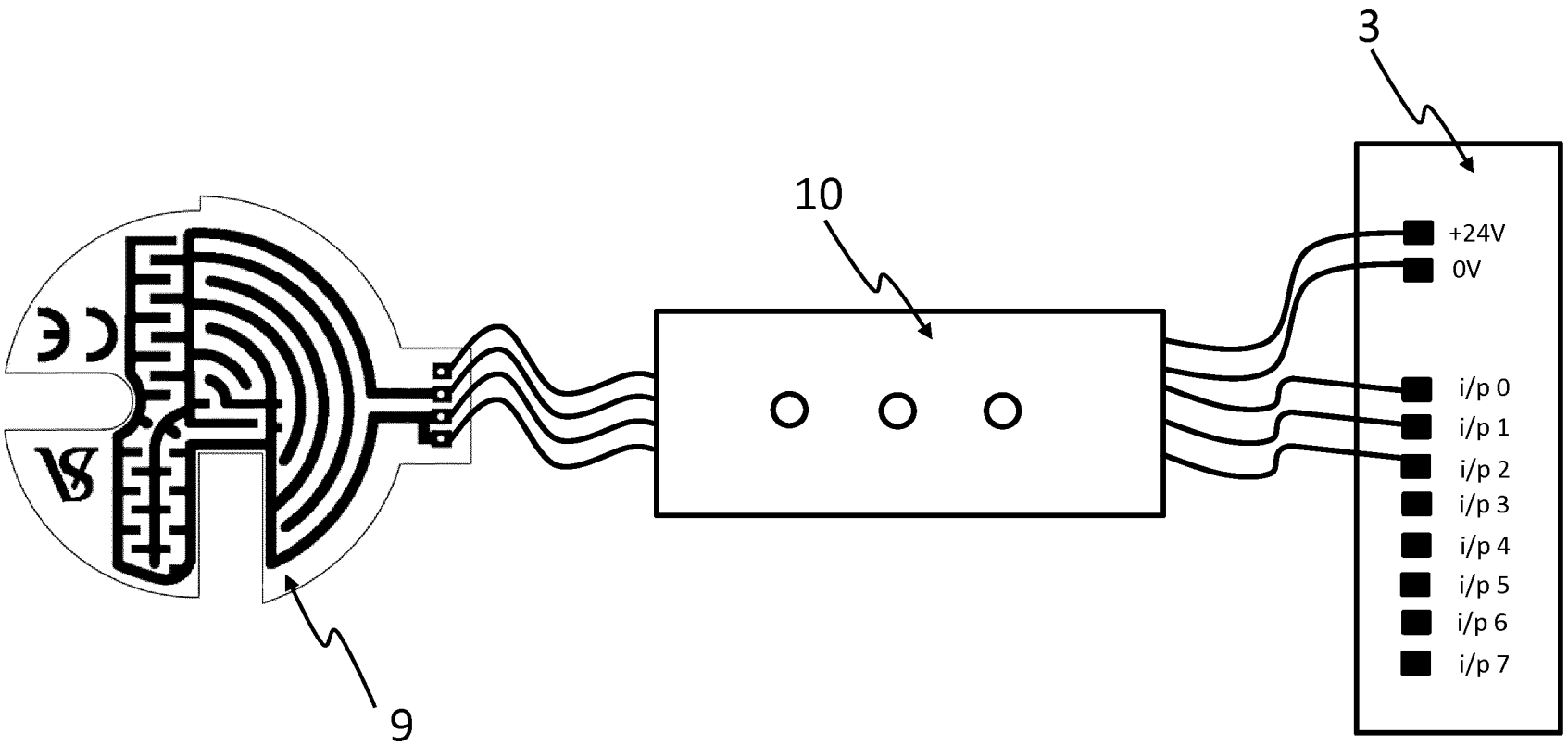
FIG. 7 shows a schematic design of an exemplary connection between sensor controller and PLC according to a preferred embodiment of the invention.

FIG. 7 exhibits the signals sent to the sensor controller (10) from the sensing leak pad (9) and from the sensor controller (10) to the PLC (3) which processes the signals before sending to the printer controller. Upon receiving "Ink Leak Signal" the PLC (3) will send the stop printing signal to the printer controller, and the action will follow to retract the print head nozzle as a shutdown initiation process which at the same time will send a log to a HMI control system which stops the productions.

The manufacturer's conveyor will be stop and an alarm signal will be activated for verification and possibly for cleaning.

A Software Enhanced Printer Security system might perform the following functions upon receiving the signals from the sensor controller as these 2 conditions:

1) During Normal Production:
a) Connected Signal On
b) Mounted Signal: On
c) Leak Signal: Off
2) During Normal Production (Leak Detection):
a) Connected Signal: On
b) Mounted Signal: On
c) Leak Signal: On Any other combinations of signals or presence of any signal, as a security precaution combination matrix the system will detect as 'ABNORMAL'. This will send an "Abnormal" or "Security Breached" alarm which needs authorized person to visit the printer and verify the system (e.g. with OTP password) before enabling the production back to normal.

REFERENCE NUMERALS 1 inkjet printing system
2 printer
3 PLC
4 Security cabinet
5 Umbilical cord
6 Printhead holster
7 Product
8 Conveyor
9 Leak detection pad
10 Sensor controller
11 Signal cable
12 Notification device
13 Output cable
14 Transducer
15 Charge electrode
16 Deflection plate
17 Driver
18 Charge driver
19 Opening
20 Ink
21 Object
22 Direction of motion of object
23 Gutter
24 Collector
25 Pump
26 Head holder
27 Slot
28 Substrate
29 Tracks
30 Pins

The invention claimed is:

1. A system for detecting ink leakage in a print head for continuous inkjet printing, comprising an inkjet print head device, a sensor controller and a main controller for monitoring the signals from a sensor, the inkjet print head device comprising a transducer, a charge electrode, a deflection plate, a gutter, and a holster, provided that the holster is receiving at least the aforementioned components of the inkjet print head device, wherein the holster comprises an opening for a dedicated outlet for the ink in a printing mode and further comprises an ink leakage detection area, the ink leakage detection area comprising a non-conductive substrate and conductive circuit provided thereon, wherein the sensor controller is operatively connected to the ink leakage detection area, wherein the ink leakage detection area is configured to send to the sensor controller an ink leak signal, a holster mounted signal and a signal referring about a wiring connection, the holster mounted signal being an indication that the ink leakage detection area hasn't been dislocated from the holster and has been mounted properly, and the signal referring about a wiring connection being an indication that no intrusion in the system or attempt to modify any wiring has taken place.

2. The system according to claim 1, wherein the ink leakage detection area is at least provided inside the holster and in a zone neighboring the outlet of the holster.

3. The system according to claim 1, wherein the ink leakage detection area is a pad.

4. The system according to claim 3, wherein the pad covers at least a part of a holster component.

5. The system according to claim 1, wherein the inkjet print head device further comprises a print head holder.

6. The system according to claim 1, further comprising a sensor for detecting unauthorized manipulation of the holster.

7. The system according to claim 6, wherein the sensor provides a signal, if the holster is connected.

8. A method for detecting ink leakage providing an ink leak signal from an ink leakage detection area of a holster of a print head device, the ink leakage detection area comprising a non-conductive substrate and conductive circuit provided thereon;

a holster mounted signal, the holster mounted signal being an indication that the ink leakage detection area hasn't been dislocated from the holster and has been mounted properly;

a signal referring about a wiring connection, the signal referring about a wiring connection being an indication that no intrusion in the system or attempt to modify any wiring has taken place;

whereas the ink leak signal, holster mounted signal and signal referring about a wiring connection are sent from the ink leakage detection area to a sensor controller and further to a control cabinet.

9. The method according to claim 8 whereas an indication is provided by the sensor controller if leakage is detected, holster is not properly closed and/or wiring is not correct, is sensed.

10. The method according to claim 9, whereas the indication is an appearance on a screen.

11. The method according to claim 9, whereas the indication of the sensor controller is light.

12. The method according to claim 11, whereas the indication of the sensor controller is LED.

13. The method according to claim 9, whereas the printing process is stopped, as soon as an indication is provided by the sensor controller to the control cabinet that leakage is detected, holster is not properly closed and/or wiring is not correct, is sensed.

* * * * *